United States Patent [19]

Mogonye

[11] Patent Number: 4,924,608

[45] Date of Patent: May 15, 1990

[54] SAFETY FOOTWEAR WITH REPLACEABLE SOLE PAD

[76] Inventor: Jerry R. Mogonye, P.O. Box 55366, Houston, Tex. 77255

[21] Appl. No.: 255,312

[22] Filed: Oct. 11, 1988

[51] Int. Cl.[5] ..... A43C 15/02

[52] U.S. Cl. ..... 36/62; 36/59 R; 15/227

[58] Field of Search ..... 15/227, 104.93; 36/1, 36/15, 59 R, 61, 62, 64, 71.5, 103, 113, 136

[56] References Cited

U.S. PATENT DOCUMENTS

| | | | |
|---|---|---|---|
| 1,136,150 | 4/1915 | McGrath | 15/227 |
| 1,651,345 | 11/1927 | Frank | 36/136 |
| 2,075,229 | 3/1937 | Rose | 15/227 |
| 2,571,606 | 10/1951 | Peterson | 15/227 |
| 2,608,007 | 8/1952 | Shapiro | 36/59 R |
| 3,027,661 | 4/1962 | McCord | 36/103 |
| 3,099,885 | 8/1963 | Jordan | 36/59 R |
| 3,258,863 | 6/1966 | Paget | 36/62 |
| 3,362,775 | 1/1968 | Muecke | 15/227 |
| 3,460,182 | 8/1969 | Grande | 15/227 |
| 3,526,014 | 9/1970 | Edwards | 15/227 |
| 3,526,917 | 9/1970 | Haywood | 15/104.93 |
| 3,680,170 | 8/1972 | Sims | 15/227 |
| 4,217,704 | 8/1980 | Whitaker | 36/59 R |
| 4,697,295 | 10/1987 | Garrison | 36/136 |
| 4,702,021 | 10/1987 | Cameron | 36/59 R |

FOREIGN PATENT DOCUMENTS

| | | | |
|---|---|---|---|
| 108670 | 9/1927 | Austria | 36/113 |
| 764103 | 5/1934 | France | 36/136 |
| 101582 | 10/1923 | Switzerland | 15/227 |

*Primary Examiner*—Werner H. Schroeder
*Assistant Examiner*—Diana L. Biefeld
*Attorney, Agent, or Firm*—Neal J. Mosely

[57] ABSTRACT

A safety shoe for use in working on slippery surfaces has an upper portion secured to a flexible rubber sole. A flexible fastener secured to the bottom of the sole has hooked elements which removably secure a fibrous sole pad thereon. The juncture of the upper and sole is overlapped by a rubber strip element which secures the juncture and provides improved appearance. A conventional toe guard may be affixed to the perimeter of the toe portion of the strip element. A cushioned inner pad is contained within the shoe on the top surface of the sole. The preferred sold pad is formed of interlocked polyester or nylon fibers to provide a long-lasting pad which is not appreciably depreciated by floor cleaning compounds and provides traction on the slippery surface. The sole pads are of a material conventionally used in cleaning floors and in stripping wax from floors. The sole pads are secured by a pressing them onto the bottom of the shoe and are removed by peeling them off. They may also be provided in sets ranging in thickness and density, and varying fiber materials to adapt to various types of working conditions. In addition to providing the desired traction on slippery surfaces, the sole pads may be used to exert concentrated scrubbing action by foot motion.

15 Claims, 1 Drawing Sheet

FIG. 1
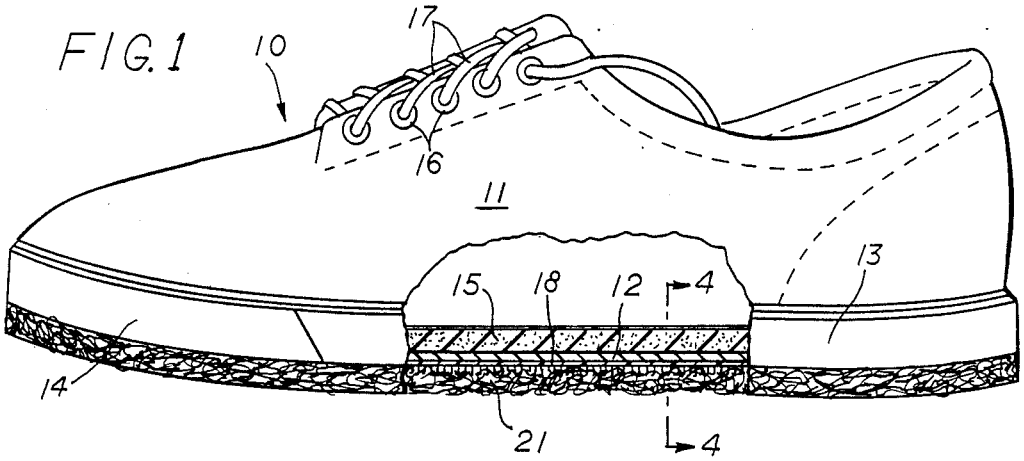
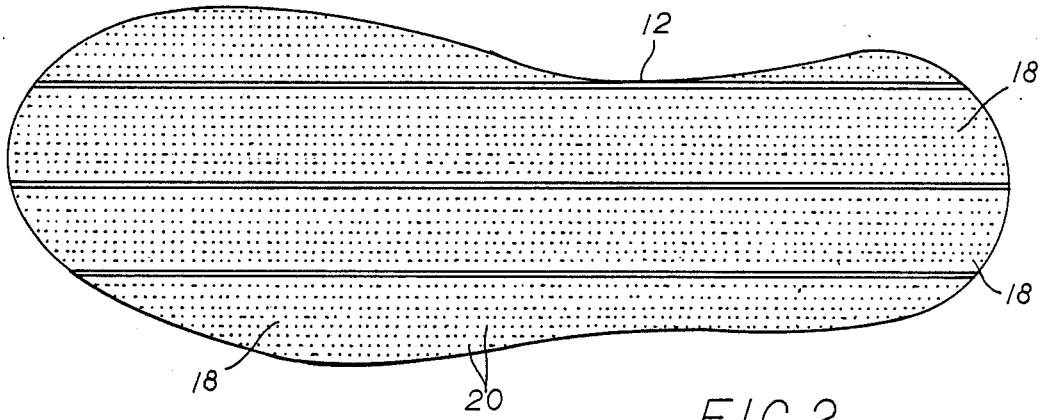
FIG. 2
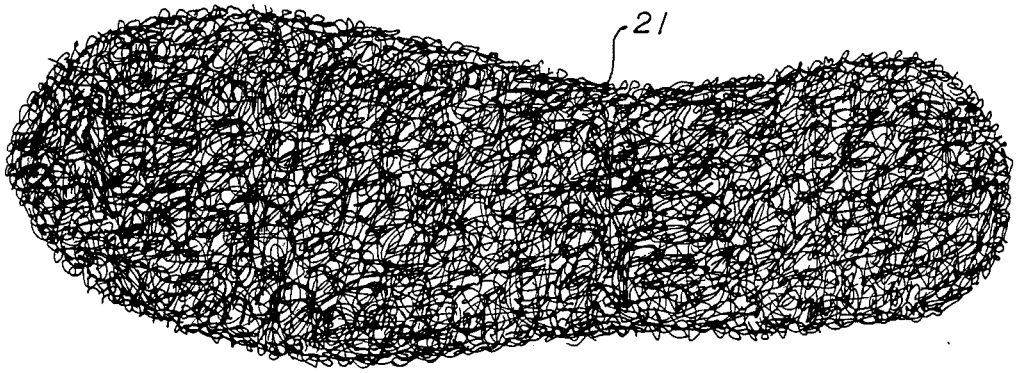
FIG. 3
FIG. 4
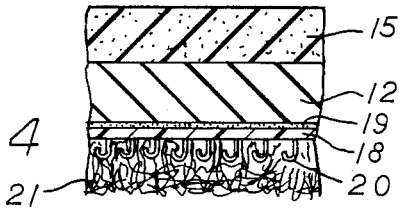

SAFETY FOOTWEAR WITH REPLACEABLE SOLE PAD

BACKGROUND OF THE INVENTION

1. Field of the Invention

This invention relates generally to safety footwear for working on slippery surfaces and more particularly to safety footwear having a replaceable sole pad removably secured thereon.

2. Brief Description of the Prior Art

A major problem in the janitorial industry relates to workers who slip and fall when working with mop water, wax, restoration and wax strippers. Injuries cause the contractor additional expenses from insurance and workers compensation claims. The amount of labor hours required to complete the task of working on a slippery surface makes the job an economically marginal one. Therefore, the need exists for a shoe suitable for wearing while working on slippery surfaces to allow the worker to perform the task safely and quickly, while reducing the possibility of injury.

There are several patents which disclose various shoes having safety soles, however, none of the references show the novel features of this invention or have the utility or the desirable combination of features of the present invention.

Jordan et al, U.S. Pat. No. 3,099,885 discloses an antislip device applied to the sole and/or heel of a boot or shoe comprising a top thin layer of rubber with sand on the top surface which is secured to the sole of the boot or shoe and a thicker layer of felt attached to the rubber which forms the bottom surface of the device. This device is not replaceable, nor is it suitable for use on slippery floors.

Sims, U.S. Pat. No. 3,699,672 discloses a flexible pad of abrasive material held across the sole of a shoe by an elastic strap which fits over the upper portion of the shoe. Velcro fasteners at the ends of the elastic strap are used to conform the ends of the pad in an overlapped position on the side edges of the shoe. The pad may be used for safety or for spot cleaning of the floor.

Moore, U.S. Pat. No. 4,007,549 discloses an athletic shoe having a non-replaceable sole formed of artificial turf material to provide traction on the playing surface of an athletic field. This device is not replaceable, nor is it suitable for use on slippery floors.

Whitiker, U.S. Pat. No. 4,217,704 is directed to the specific construction of a safety shoe consisting of a rubber shell or overshoe worn over a conventional shoe and a synthetic fiber polishing mat permanently bonded to the bottom as the sole.

Williams, U.S. Pat. No. 4,489,510 is directed to the specific construction of a rubber or plastic slipper cover or overshoe which fits over a conventional shoe and has a series of thin synthetic fiber polishing pads permanently mounted to the bottom in telescoped and overlapped relation as the sole.

The present invention is distinguished over the prior art in general, and these patents in particular by a safety shoe for use in working on slippery surfaces which has an upper portion secured to a flexible rubber sole and a flexible fastener secured to the bottom of the sole having hooked elements which removably secure a fibrous sole pad to the bottom of the shoe. The juncture of the upper and sole is overlapped by a rubber strip element which secures the juncture and provides improved appearance. A conventional toe guard may be affixed to the perimeter of the toe portion of the strip element. A cushioned inner pad is contained within the shoe on the top surface of the sole. The preferred sole pad is formed of interlocked polyester or nylon fibers to provide a long lasting pad which is not appreciably depreciated by floor cleaning compounds and provides traction on the slippery surface. The sole pads are of a material conventionally used in cleaning floors and in stripping wax from waxed floors. The sole pads are secured by a pressing them onto the bottom of the shoe and are removed by peeling them off. They may also be provided in sets ranging in thickness and density, and varying fiber materials to adapt to various types of working conditions. In addition to providing the desired traction on slippery surfaces, the sole pads may be used to exert concentrated scrubbing action by foot motion.

SUMMARY OF THE INVENTION

It is therefore an object of the present invention to provide footwear for use while working on slippery surfaces which has a removable sole pad that is easily and quickly replaced.

It is another object of this invention to provide footwear for use while working on slippery surfaces which has a replaceable fibrous sole pad which gives the worker sure footing on slippery surfaces to reduce the possibility of injury by slipping or falling.

Another object of this invention is to provide footwear for use while working on slippery surfaces which has a replaceable sole pad of fibrous material which is not appreciably depreciated by floor cleaning compounds.

Another object of this invention is to provide footwear for use while working on slippery surfaces which has a replaceable sole pad of fibrous material which permits normal flexing of the shoe.

Another object of this invention is to provide footwear for use while working on slippery surfaces which is supplied with a series of replaceable sole pads of fibrous material ranging in thickness and density, and fiber materials to adapt to various types of working conditions.

Another object of this invention is to provide footwear for use while working on slippery surfaces which has a replaceable sole pad of fibrous material which allows the worker to complete tasks of working on the slippery surface in less time than when wearing conventional soled shoes.

A further object of this invention is to provide footwear for use while working on slippery surfaces which has a replaceable sole pad of fibrous material which, in addition to providing traction on slippery surfaces, may be used to exert concentrated scrubbing action by foot motion on a floor area such as in a corner or where gum or the like has been stuck to the floor.

A still further object of this invention is to provide footwear for use while working on slippery surfaces which has a replaceable sole pad of fibrous material which is simple in construction, economical to manufacture, and safe, rugged and durable in use.

A still further object of this invention is to provide footwear for use while working on slippery surfaces which has a replaceable sole pad of fibrous material conventionally used in cleaning floors and in stripping wax from waxed floors.

Other objects of the invention will become apparent from time to time throughout the specification and claims as hereinafter related.

The above noted objects and other objects of the invention are accomplished by a safety shoe for use in working on slippery surfaces which has an upper portion secured to a flexible rubber sole and a flexible fastener secured to the bottom of the sole having hooked elements which removably secure a fibrous sole pad to the bottom of the shoe. The juncture of the upper and sole is overlapped by a rubber strip element which secures the juncture and provides improved appearance. A conventional toe guard may be affixed to the permiter of the toe portion of the strip element. A cushioned inner pad is contained within the shoe on the top surface of the sole. The preferred sole pad is formed of interlocked polyester or nylon fibers to provide a long lasting pad which is not appreciably depreciated by floor cleaning compounds and provides traction on the slippery surface. The sole pads are of a material conventionally used in cleaning floors and in stripping wax from waxed floors. The sole pads are secured by a pressing them onto the bottom of the shoe and are removed by peeling them off. They may also be provided in sets ranging in thickness and density, and varying fiber materials to adapt to various types of working conditions. In addition to providing the desired traction on slippery surfaces, the sole pads may be used to exert concentrated scrubbing action by foot motion.

BRIEF DESCRIPTION OF THE DRAWINGS

FIG. 1 is a side elevation of a shoe having a replaceable sole pad removably secured thereon in accordance with the present invention.

FIG. 2 is a top plan view of the sole of the shoe with the replaceable sole pad removed.

FIG. 3 is a top plan view of a replaceable sole pad.

FIG. 4 is a partial cross section through the sole portion of the shoe taken along the line 4—4 of FIG. 1.

DESCRIPTION OF THE PREFERRED EMBODIMENT

Referring to the drawings by numerals of reference, there is shown in FIG. 1, a preferred shoe 10 employing a removable sole pad and partially cut-away to illustrate the internal shoe construction. The shoe 10 has an upper portion 11 secured to a flexible rubber bottom or sole 12 by conventional means, such as heat curing, adhesives or epoxy. The juncture of the upper 11 and sole 12 is overlapped by a rubber strip element 13 which secures the juncture and provides improved appearance. A conventional toe guard 14 may be affixed to the perimeter of the toe portion of the strip element 13. A cushioned inner pad 15 is contained within the shoe 10 on the top surface of the sole 12. The preferred upper portion 11 is formed of canvas, leather, or other suitable material and in the form of a conventional tennis shoe or deck shoe and may be provided with eyelets 16 and shoelaces 17 for effecting a comfortable secure fit. Arch supports may also be installed.

One or more strips of a flexible fastener material 18 is secured to the bottom surface of the sole 12 by means of a suitable water resistive flexible adhesive or epoxy 19 which is not susceptible to chemicals commonly used in floor cleaning compounds, by sewing, or a combination of the above. The fastener strip 18 may be a single piece of material cut to the plan shape of the sole 12 to completely cover the sole. The outer surface of the fastener strip or strips 18 comprises a plurality of small hooks 20. A preferred fastener strip 18 is formed of the hook element of a material commonly known as Velcro. The preferred material for the fastener strip is a suitable flexible plastic which is not appreciably depreciated by floor cleaning compounds.

A flexible sole pad 21 of non-woven synthetic fibrous material is cut to the plan shape of the sole 12. A preferred sole pad material is formed of material such as that manufactured and sold as floor maintenance pads for use on power driven floor maintenance machines conventionally used in cleaning floors and in stripping wax from waxed floors. Commonly, such pads range in thickness and density, and have varying fiber characteristics providing differing traction properties and degrees of abrasiveness for cleaning and polishing. The preferred sole pad 21 is formed of interlocked polyester or nylon fibers to provide a long lasting pad which is not appreciably depreciated by floor cleaning compounds. Floor maintenance pads such as those marketed by Microtron Abrasives, Inc. under the trademark Ultra Polyline Pads, Ultra Valuline Pads, Ultra Thinline Pads, and Customized Pads are useful as sole pad materials for safety shoes produced according to this invention.

The sole pads and fastener strips may also be sold in kit form whereby the purchaser may apply the fastener strips and soles to conventional shoes.

OPERATION

In use the, worker presses the replaceable sole pad 21 onto the fastener strip 20 on the bottom of each shoe and puts the shoes on. The fibrous sole pad 21 provides sure footing on all types of slippery surfaces and may flex to permit normal flexing of the shoe. With the footwear of the present invention, the worker can complete the task of working on the slippery surface in less time than when wearing conventional rubber soled shoes and without substantial risk of slipping or falling.

Having a supply of precut replaceable sole pads allows the worker to quickly remove the pad when it becomes dirty if he feels the floor becoming slippery by peeling it off the sole of the shoe and replacing it with a fresh sole pad. The sole pads may also be provided in sets ranging in thickness and density, and varying fiber materials to adapt to various types of working conditions. For example, sole pads having different traction characteristic may be desired when working with soapy water or detergents, wax, wax strippers, or restoration compounds. In addition to providing the desired traction on slippery surfaces, the sole pads may be used to exert concentrated scrubbing action by foot motion on a floor area such as in a corner or where gum or the like has been stuck to the floor.

While this invention has been described fully and completely with special emphasis upon a preferred embodiment, it should be understood that within the scope of the appended claims the invention may be practiced otherwise than as specifically described herein.

I claim:

1. Safety footwear having a replaceable sole pad for use in working on slippery surfaces to prevent the wearer from slipping comprising:

a shoe having an upper portion to substantially cover the foot of the wearer and a flexible sole portion secured at the bottom thereof, flexible fastener means secured by a layer of water- and chemical-resistant adhesive covering the entire bottom surface of said flexible sole portion, which comprises one or more thin strip elements having a plurality of hooking elements projecting from the bottom surface, and a flexible sole pad of non-woven synthetic fibrous material releasably attached to said fastener means and having the plan shape of said sole to substantially cover the entire bottom surface of the shoe, the fibrous material of said sole pad being interengageable with said hooking elements by pressing said sole pad on said hooking elements to releasably secure said sole pad to the bottom of the shoe and removable therefrom by pulling said sole pad from said hooking elements, said sole pad material having fiber characteristics sufficient to provide the shoe wearer traction on a slippery surface when standing or walking and said adhesive, said flexible fastener means and said sole pad materials being resistant to water and to deterioration by floor cleaning compounds conventionally used in cleaning floors and in stripping wax from waxed floors.

2. Safety footwear according to claim 1 including;

a rubber strip element secured to the juncture of said upper portion and said sole portion to surround and reinforce the juncture and provide an aesthetic appearance.

3. Safety footwear according to claim 2 including;

a toe guard strip affixed to the perimeter of the toe portion of said rubber strip element.

4. Safety footwear according to claim 1 including;

a cushioned inner pad contained within the shoe on the top surface of said sole portion.

5. Safety footwear according to claim 1 in which;

said upper portion is formed of strong lightweight flexible material.

6. Safety footwear according to claim 1 in which;

said upper portion has eyelets and shoelaces for effecting a comfortable secure fit.

7. Safety footwear according to claim 1 in which;

said sole pads comprise a series of selectively interchangeable pads having different fiber characteristics sufficient to provide the shoe wearer traction on various types of slippery surfaces when standing or walking under differing types of working conditions.

8. Safety footwear according to claim 1 in which;

said sole pads are formed of non-woven synthetic fibrous polyester material conventionally used in cleaning floors and in stripping wax from waxed floors.

9. Safety footwear according to claim 1 in which;

said sole pads are formed of non-woven synthetic fibrous nylon material conventionally used in cleaning floors and in stripping wax from waxed floors.

10. Safety footwear according to claim 1 in which;

said sole pad material having abrasive fiber characteristics whereby the shoe wearer may clean or polish a floor surface by foot action.

11. A safety sole pad for attachment to the bottom surface of footwear for use in working on slippery surfaces to prevent the wearer from slipping comprising;

a flexible sole pad of non-woven synthetic fibrous material cut generally in the plan shape of the sole of the footwear to substantially cover the entire bottom surface thereof, said sole pad material having fiber characteristics sufficient to provide the wearer traction on a slippery surface when standing or walking and to substantially resist deterioration by floor cleaning compounds and having a texture such that the fibers are securable to a Vel-Cro type hook fastener secured on the bottom of a shoe to which the pad is secured.

12. A safety sole pad according to claim 11 in which said sole pads comprise a series of selectively interchangeable pads having different fiber characteristics sufficient to provide the wearer traction on various types of slippery surfaces when standing or walking under differing types of working conditions.

13. A safety sole pad according to claim 11 in which said sole pads are formed of non-woven synthetic fibrous polyester material conventionally used in cleaning floors and in stripping wax from waxed floors.

14. A safety sole pad according to claim 11 in which said sole pads are formed of non-woven synthetic fibrous nylon material conventionally used in cleaning floors and in stripping wax from waxed floors.

15. A safety sole pad according to claim 11 in which said sole pad material having abrasive fiber characteristics whereby the wearer may clean or polish a floor surface by foot action.

* * * * *